US007131219B2

(12) United States Patent
Chen et al.

(10) Patent No.: US 7,131,219 B2
(45) Date of Patent: Nov. 7, 2006

(54) SHOE WITH LEG SUPPORT

(75) Inventors: Eddie Chen, 9F, No. 201, Sec. 1, Taichung-Kang Rd., Taichung City (TW); Paul Yang, Taichung (TW)

(73) Assignee: Eddie Chen, Taichung City (TW)

( * ) Notice: Subject to any disclaimer, the term of this patent is extended or adjusted under 35 U.S.C. 154(b) by 46 days.

(21) Appl. No.: 10/966,890

(22) Filed: Oct. 15, 2004

(65) Prior Publication Data

US 2006/0080864 A1 Apr. 20, 2006

(51) Int. Cl.
*A43B 7/20* (2006.01)

(52) U.S. Cl. ..... 36/89; 36/51; 36/50.1

(58) Field of Classification Search ..... 36/89, 36/90, 128, 51, 50.1
See application file for complete search history.

(56) References Cited

U.S. PATENT DOCUMENTS 1,863,592 A * 6/1932 Dawes ..... 36/50.1
1,908,293 A * 5/1933 Holmes ..... 36/50.1
4,282,657 A * 8/1981 Antonious ..... 36/50.1
5,175,947 A 1/1993 Parracho ..... 36/89
6,952,891 B1 * 10/2005 Hirayama ..... 36/50.5
2006/0032090 A1 * 2/2006 Chen et al. ..... 36/58.5

* cited by examiner

*Primary Examiner*—Ted Kavanaugh
(74) *Attorney, Agent, or Firm*—DLA Piper US LLP

(57) ABSTRACT

An upper has a front shell portion and a rear shell portion which includes a rear wall part, a front wall part, left and right wall parts that cooperate to confine a receiving space to receive the leg of the wearer. A leg support member is attached to an inner surface of the rear shell portion and extends from the rear wall part to the left and right wall parts. At least one of two end portions of the leg support member extends forwardly and outwardly from the rear shell portion and is manipulatable to tighten the leg support member around the wearer's leg so as to support and comfort the wearer's leg.

16 Claims, 11 Drawing Sheets

SHOE WITH LEG SUPPORT

BACKGROUND OF THE INVENTION

1. Field of the Invention

This invention relates to a shoe, more particularly to a shoe incorporating a leg support member disposed within an upper to surround and support the leg and/or ankle of a wearer.

2. Description of the Related Art

It is known in the art to provide a sandal with an ankle strap in addition to toe straps in order to enhance retention of the sandal on the foot of a wearer and to improve the comfort and support provided by the sandal.

It is also known that shoes are provided with ankle supports in order to prevent the ankle of wearers from undesirable twisting movement which can injure the wearers' ankle. An example of such shoes is disclosed in U.S. Pat. No. 5,175,947 in which a removable ankle support 1 is attached to an outer side of an upper as shown in FIG. 1. The ankle support 1 has two sheet springs respectively attached to two sides of the upper and can be tightened around the upper at a position corresponding to the wearer's ankle. The ankle support 1 disclosed in this patent is provided outside the upper.

While various ankle supports have existed in the art, further development is still needed for improvements in foot, leg and/or ankle support systems incorporated into shoes.

SUMMARY OF THE INVENTION

The object of the present invention is to provide a shoe with a simple leg support member which is disposed within an upper and which can be tightened around the leg and/or ankle of a wearer so as to support and tighten the wearer's foot, leg and/or ankle.

According to the present invention, a shoe comprises an upper including a rear shell portion, and a front shell portion extending forwardly from the rear shell portion. The rear shell portion includes a rear wall part, a front wall part, and left and right wall parts extending between the rear and front wall parts. The rear, front, left and right wall parts confine a receiving space which opens upward. The shoe further comprises a leg support member disposed within the rear shell portion and attached to an inner surface of the rear shell portion. The leg support member extends from the rear wall part to the left and right wall parts and has two end portions. At least one of the end portions extends forwardly and outwardly from the receiving space and is manipulatable to tighten the leg support member around the leg of a wearer.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
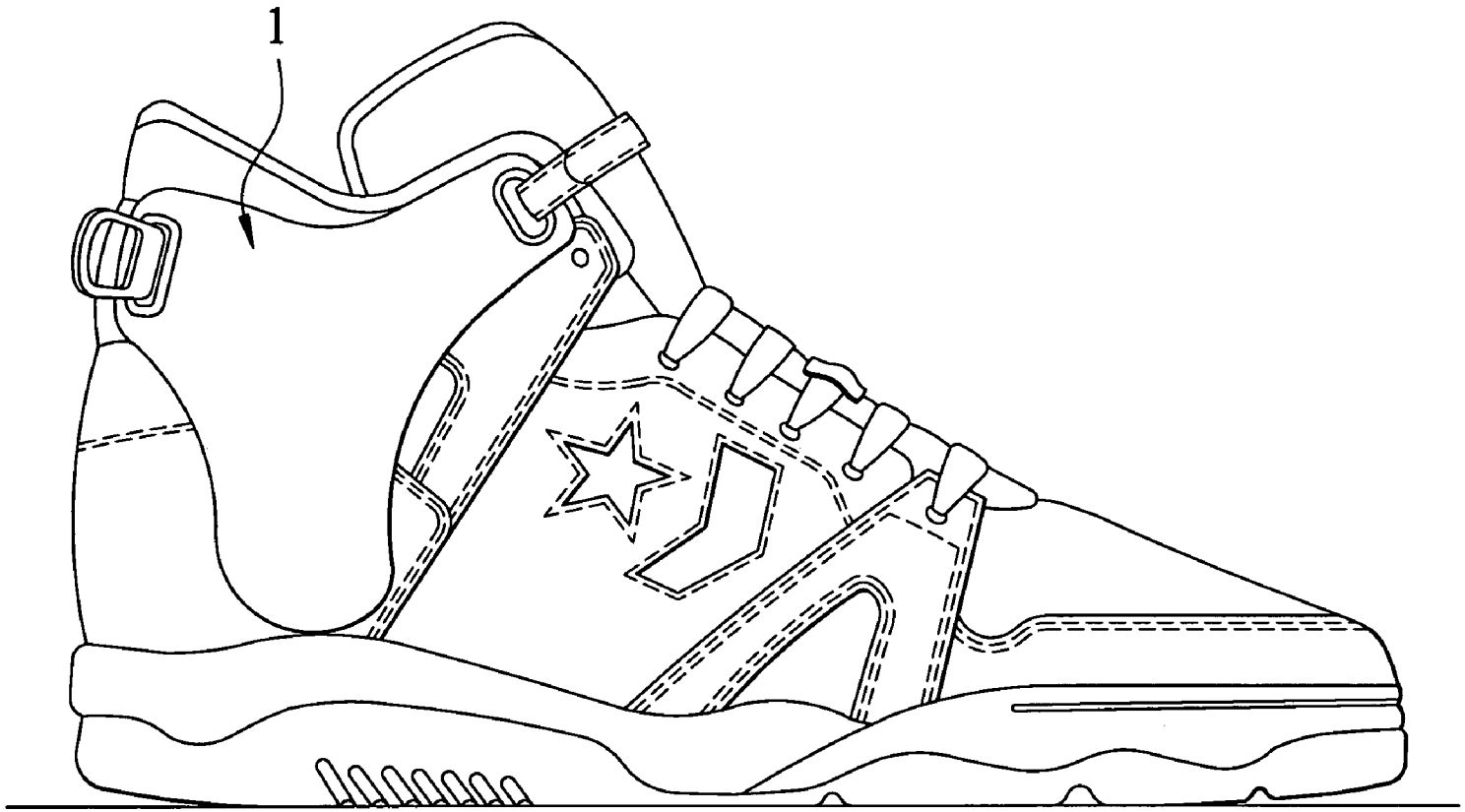
FIG. 1 PRIOR ART
FIG. 1 is a side view of a conventional shoe.

Before the present invention is described in greater detail, it should be noted that same reference numerals have been used to denote like elements throughout the specification.

Figure 2:
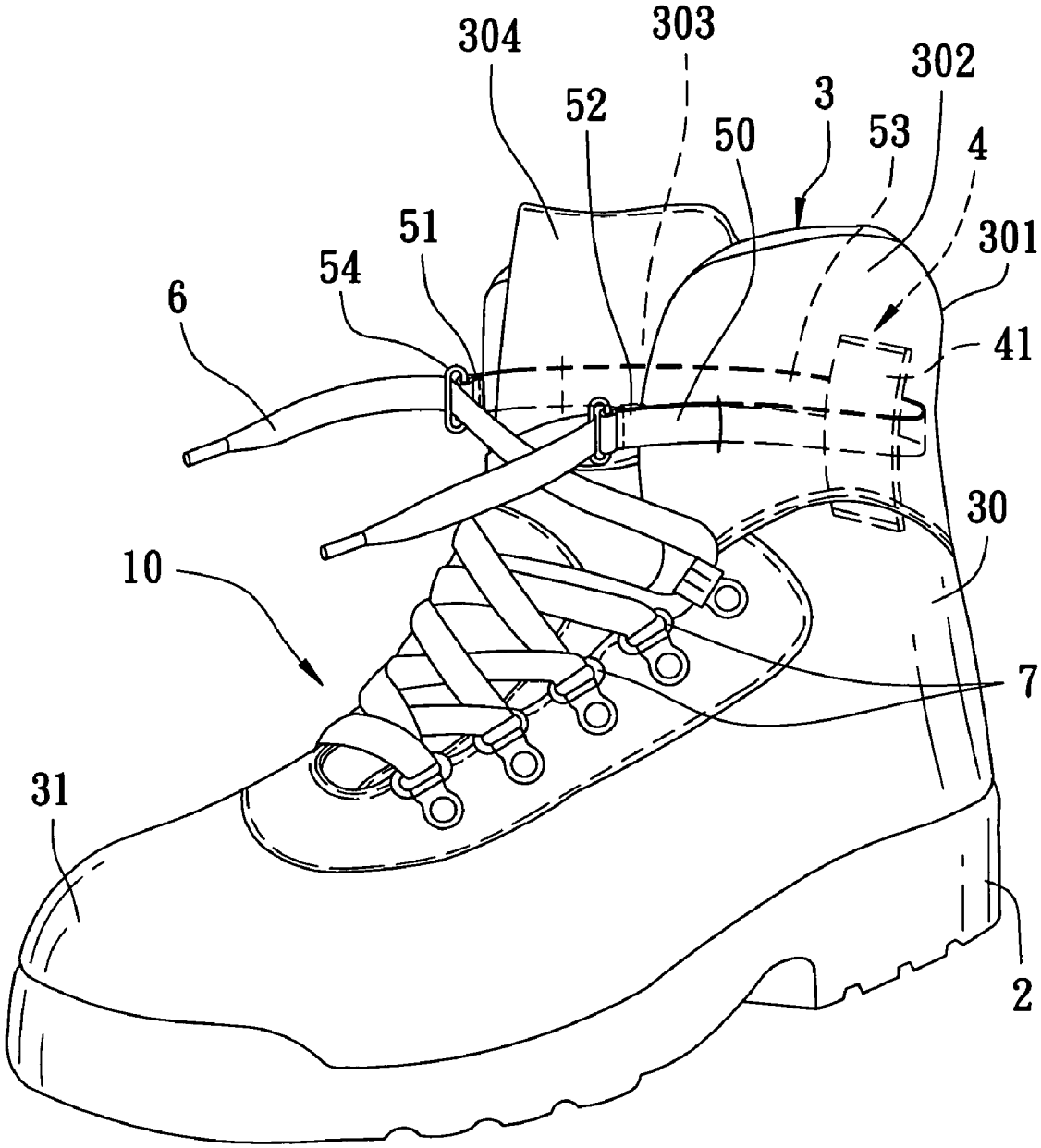
FIG. 2 is a perspective view of the first preferred embodiment of the present invention.
Figure 3:
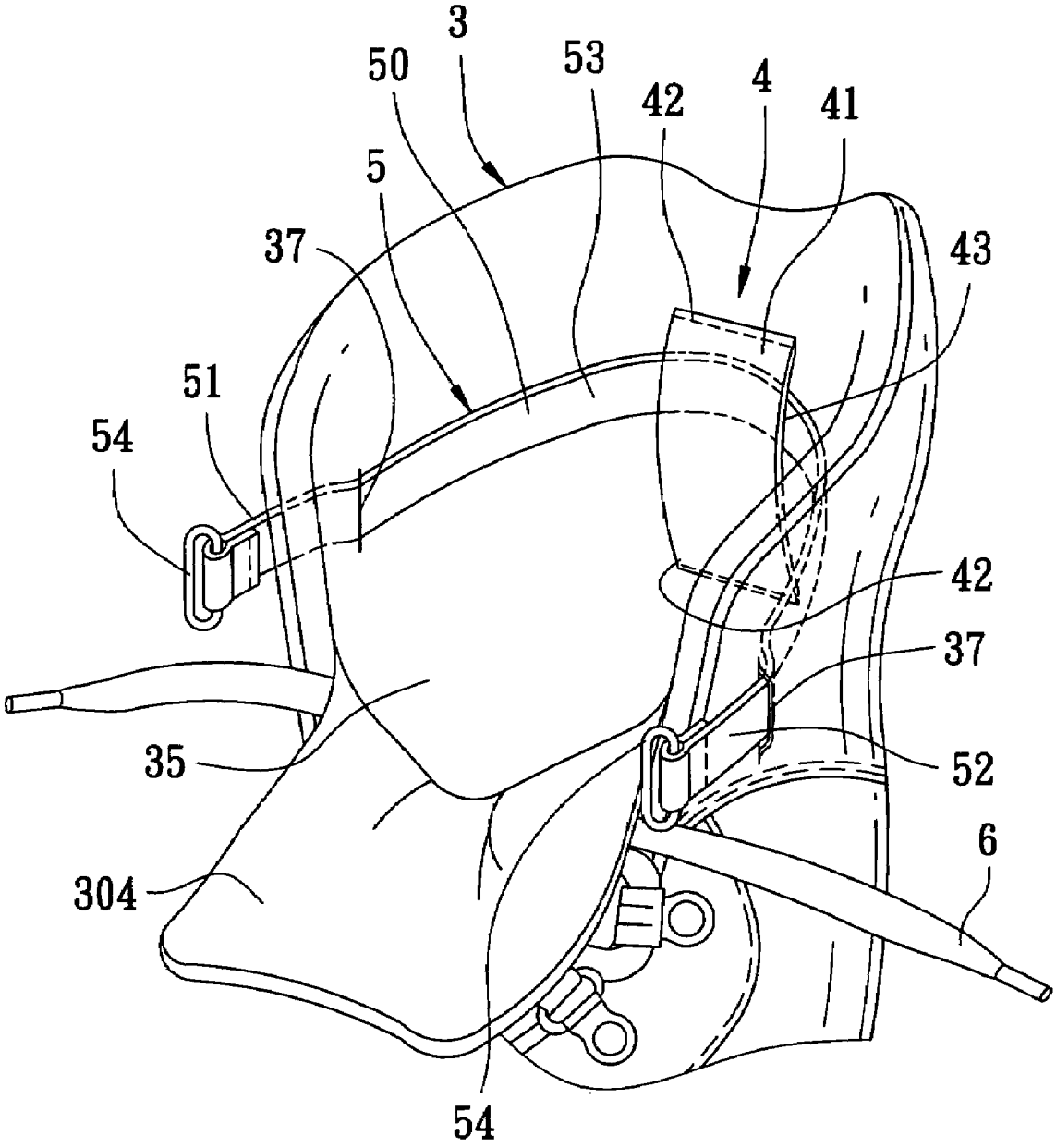
FIG. 3 is a fragmentary perspective view of the first preferred embodiment.

Referring to FIGS. 2 and 3, a first preferred embodiment of the shoe according to the present invention is shown at (10) and includes an outsole 2 connected to an upper 3, an attachment unit 4 and a leg support member 5. The shoe 10 may be a sport shoe, climbing shoe, waterproof shoe, hiking shoe, hunting shoe or snow shoe. The upper 3 includes a rear shell portion 30 and a front shell portion 31 extending forwardly from the rear shell portion 30. The rear shell portion 30 includes a rear wall part 301, a front wall part 304, and left and right wall parts 302, 303 which cooperatively confine a receiving space. The receiving space opens upward and is to receive the leg of a wearer. The front wall part 304 includes a tongue which covers a tongue opening 35 formed in the upper 3.

The leg support member 5 is disposed within the rear shell portion 30 and is attached to an inner surface of the rear shell portion 30. The leg support member 5 in this embodiment has an elongated strap 50 which includes two end portions 51 and 52 and an intermediate portion 53. The intermediate portion 53 is attached to the rear wall part 301 by means of the attachment unit 4 and extends to the left and right wall parts 302, 303. The end portions 51 and 52 extend out of the rear shell portion 30 by respectively passing through slots 37 formed in the upper 3.

The attachment unit 4 includes a sheet member 41 which is elastic and has two ends 42 secured to an inner surface of the rear wall part 301. A passage 43 is thus formed between the sheet member 41 and the rear wall part 301. The intermediate portion 53 of the strap 50 passes movably through the passage 43. The leg support member 5 further includes a fastening unit which has two fastening members 54 that are connected respectively to the two end portions 51, 52 of the strap 50.

While the sheet member 41 is elastic in this embodiment, the material and structure of the sheet member 41 should not be limited thereto. In general, the material of the sheet member 41 may be selected from composite, fabric, foam, plastic and rubber material. The structure of the sheet member 41 may be a single-layer structure or a multi-layer structure. Of course, any material or structure which can provide comfort to the wearer's foot and leg is suitable for the fabrication of the sheet member 41.

A shoelace 6 is attached to a plurality of eyelets 7 provided on the upper 3 and is connected to the fastening members 54 of the strap 50. Specifically, the fastening members 54 are formed as fastening rings, and two ends of the shoelace 6 pass through the fastening rings respectively.

Figure 4:
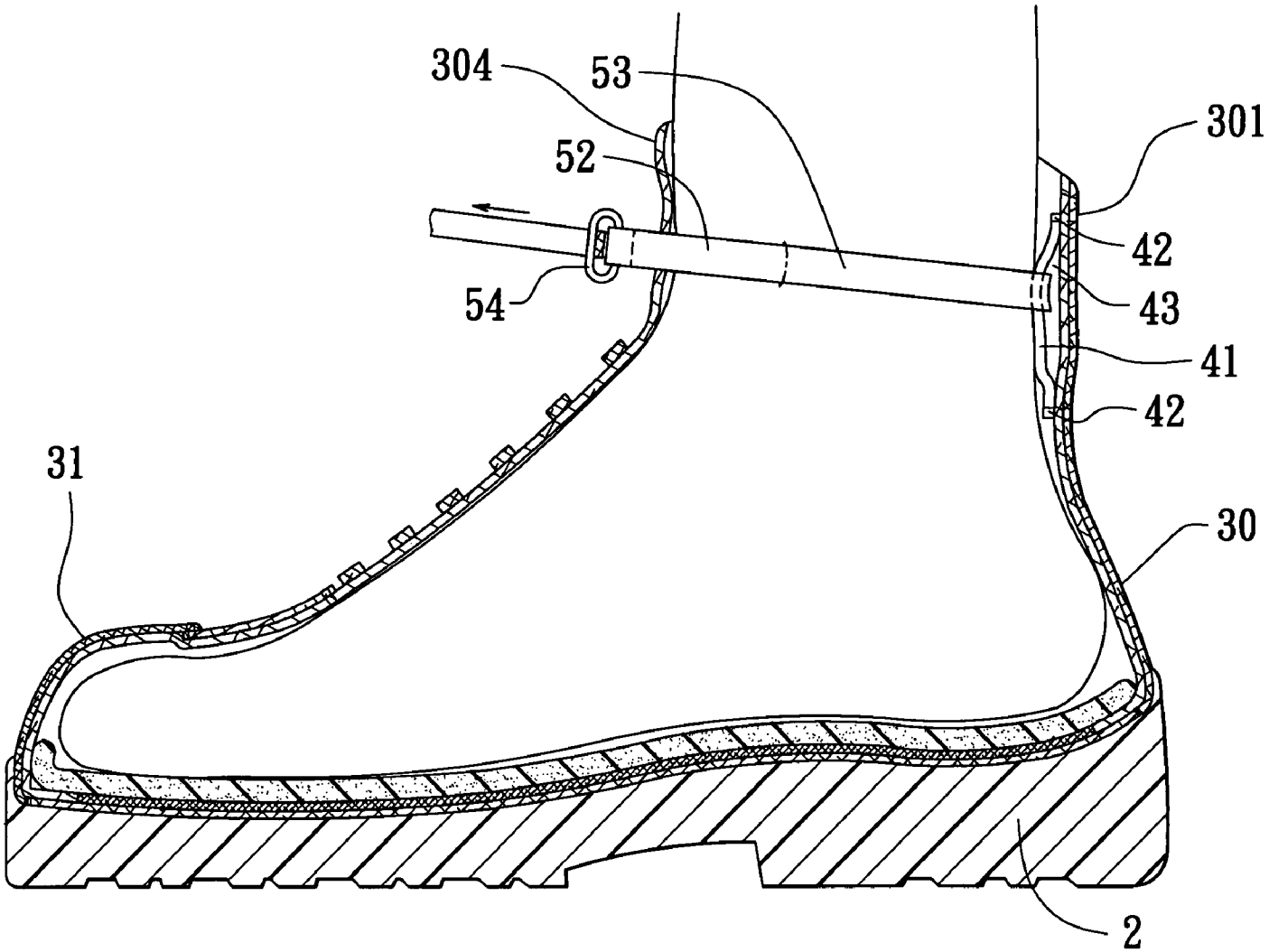
FIG. 4 is a sectional view of the first preferred embodiment.

Referring to FIG. 4, when the shoelace 6 is pulled up, the two ends portions 51 and 52 of the strap 50 are pulled by the shoelace 6 so that the strap 50 is tightened around the wearer's leg. After the strap 50 is tightened, the strap 50 can stabilize and tighten the wearer's leg and ankle. At this state, the sheet member 41 is stretched and pulled toward the wearer's leg. Accordingly, a flexible shoe lining is suitable because its flexibility can provide an advantage that the sheet member 41 is permitted to move forwardly when the strap 50 is pulled. When the strap 50 is untied, the sheet member 41 contracts and returns to its original position by virtue of its elastic property so that it will not interfere outward movement of the wearer's foot from the upper 3. The stretching and contracting forces of the sheet member 41 may be adjusted by increasing and decreasing the horizontal stretching distance which is transverse to the direction of length of the sheet member 41 and is parallel to the direction of the length of the shoe. If the horizontal stretching distance is increased forwardly, the ankle of wearers could be supported well by the sheet member 41.

Figure 5:
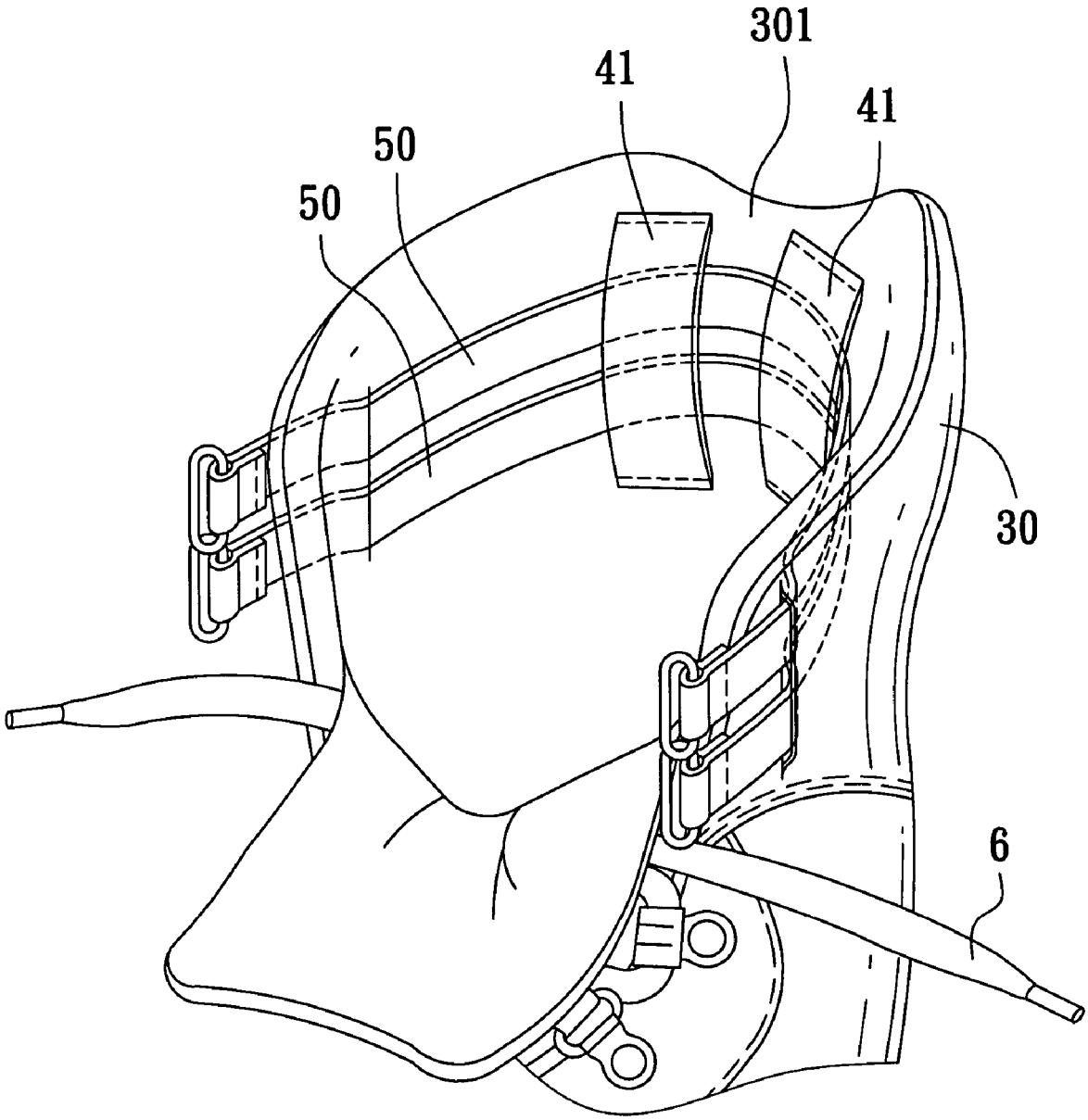
FIG. 5 is a fragmentary perspective view of the second preferred embodiment of the present invention.

Referring to FIG. 5, a second preferred embodiment of the shoe according to the present invention is shown to be similar to the first preferred embodiment except that two straps 50 are attached to the rear wall part 301 of the rear shell portion 30 by means of two sheet members 41 which are spaced apart from each other.

Figure 6:
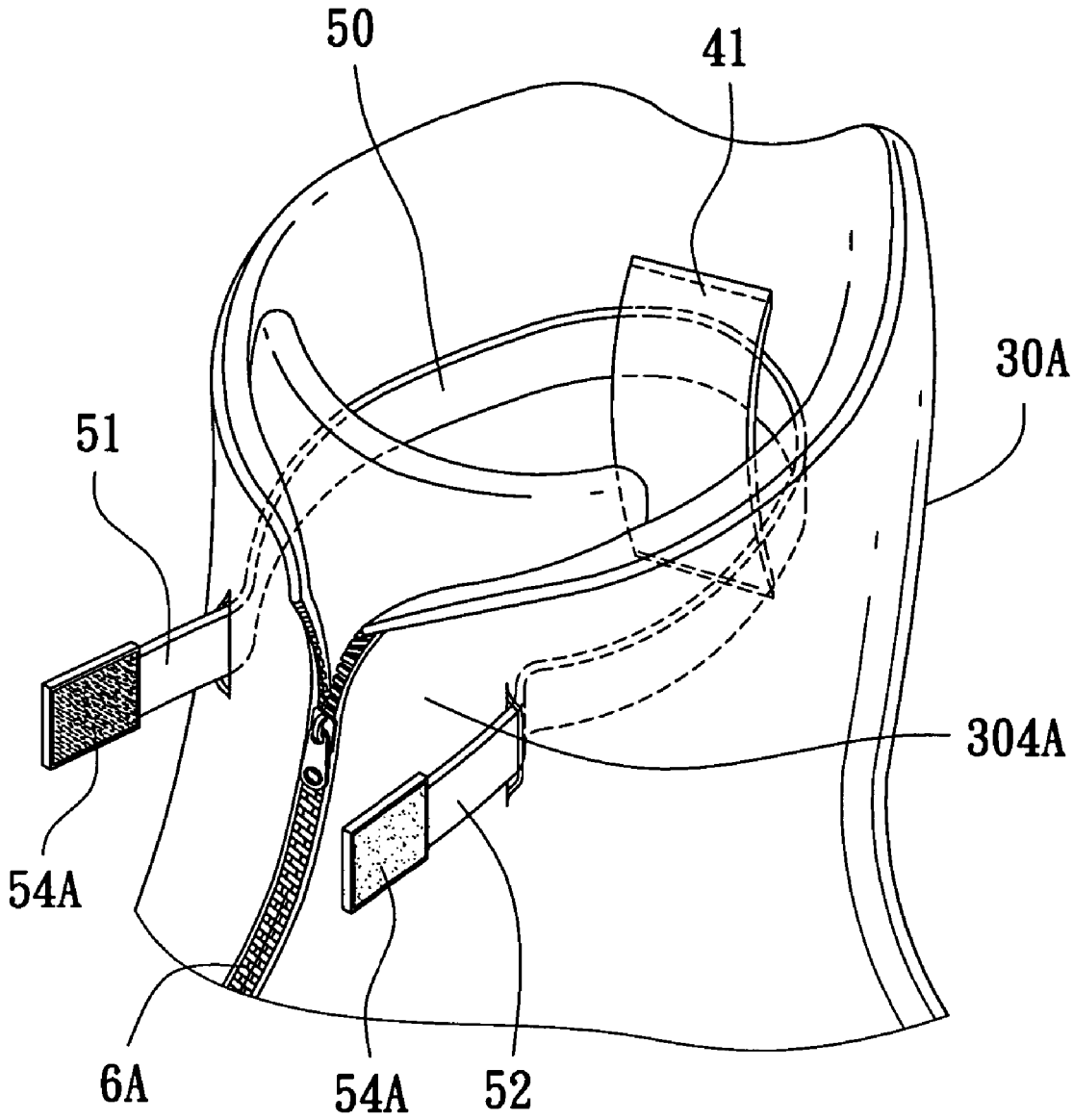
FIG. 6 is a fragmentary perspective view of the third preferred embodiment of the present invention.

Referring to FIG. 6, a third preferred embodiment of the shoe according to the present invention is shown to be similar to the first preferred embodiment. However, the front wall part 304A of the rear shell portion 30A in the third embodiment has a zipper 6A in place of the shoelace 6 used in the first embodiment, and the end portions 51, 52 of the strap 50 extend outwardly from the front wall part 304A on two sides of the zipper 6A. Fastening members 54A attached to the two end portions 51, 52 are configured as VELCRO® hook-and loop fasteners.

When the two end portions 51, 52 of the strap 50 are pulled toward each other and the fastening members 54A are subsequently interconnected, the strap 50 is tightened around the leg of the wearer.

Figure 7:
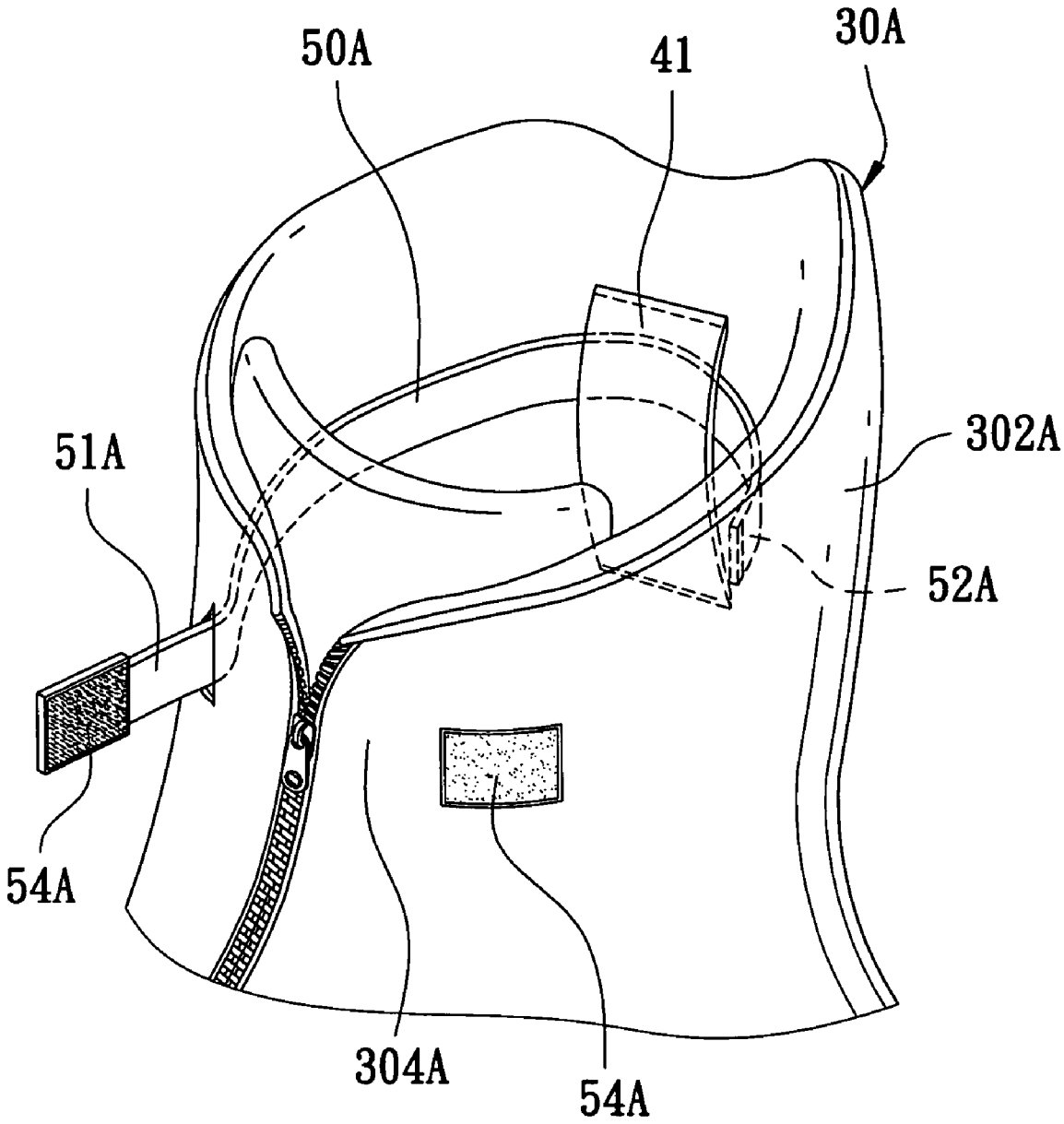
FIG. 7 is a fragmentary perspective view of the fourth preferred embodiment of the present invention.

Referring to FIG. 7, a fourth preferred embodiment of the shoe in the present invention is substantially similar to the third preferred embodiment. However, a strap 50A is used in this embodiment in place of the strap 50 of the third embodiment. An end portion 51A of the strap 50A extends outward from the rear shell portion 30A, whereas another end portion 52A is secured to an inner surface of the left wall part 302A without extending out of the rear shell portion 30A. The end portion 51A is provided with one of the fastening members 54A. The other fastening member 54A is secured to an outer side of the rear shell portion 30A. When the end portion 51A is pulled leftward to interengage the two fastening members 54A, the strap 50A can be tightened around the leg of the wearer.

Figure 8:
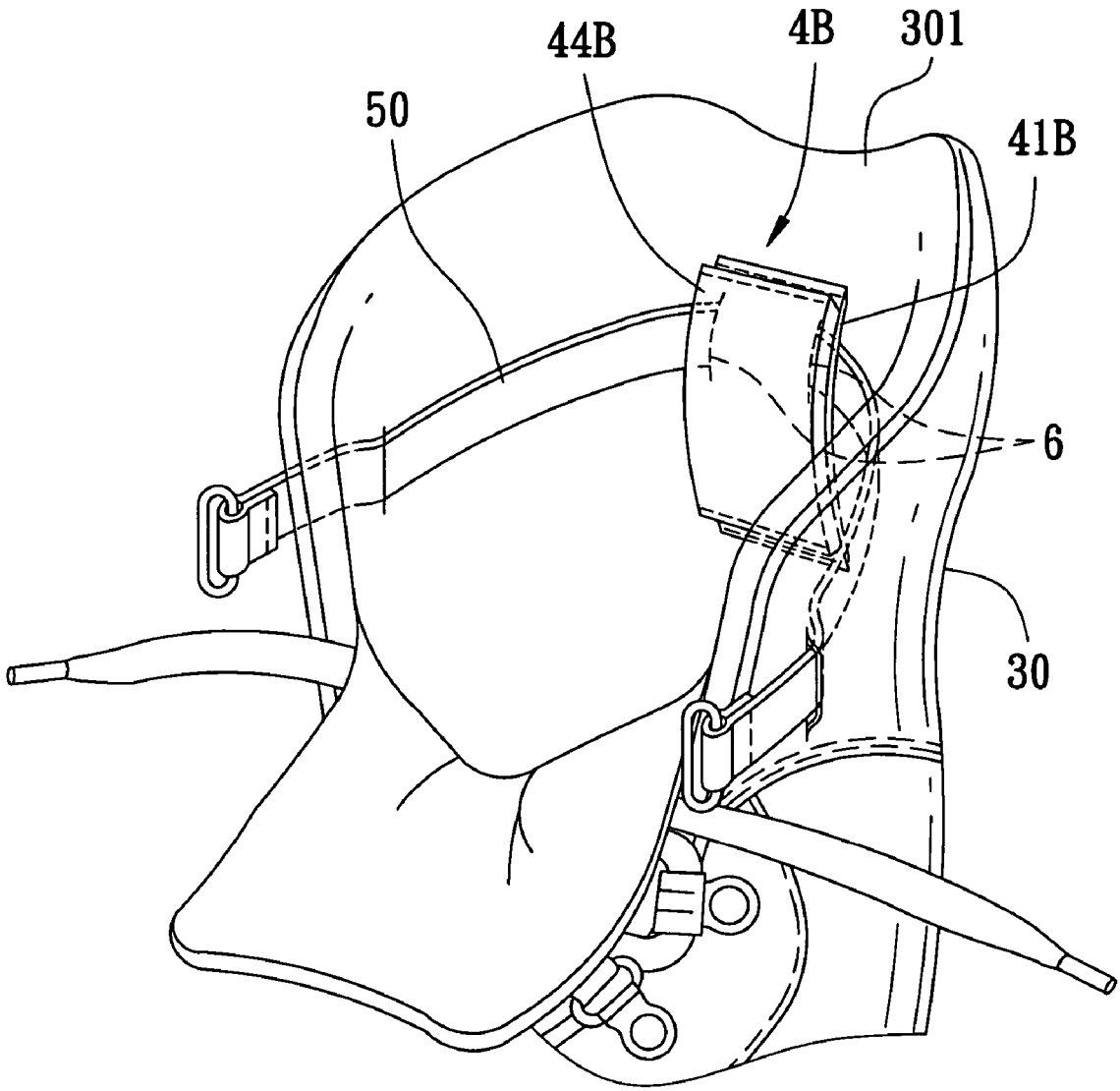
FIG. 8 is a fragmentary perspective view of the fifth preferred embodiment of the present invention.

Referring to FIG. 8, a fifth preferred embodiment of the shoe according to the present invention is substantially similar to the first preferred embodiment. However, an additional cushion pad 44B is attached to an inner surface of the rear shell portion 30 and is associated with the attachment unit 4B in the fifth preferred embodiment. Especially, the leg support member 50 is fixed immovably to the sheet member 41B by means of fixing members 6 which are sewing lines in this embodiment. Alternatively, the fixing members 6 may be any other means which could fix the leg support member 50 to the sheet member 41B. Because of the fixing members 6, the leg support member 50 is restricted from sliding freely between the sheet member 41B and the inner surface of the rear shell portion 30. Nevertheless, the strap 50 still can pull the sheet member 41B forwardly even though the leg support member 50 is fixed to the sheet member 41B by said fixing members 6.

The cushion pad 44B is superimposed on and is attached to the sheet member 41B of the attachment unit 4B. The cushion pad 44B is a soft and thick pad which is made of a soft material. In general, the cushion pad 44B is softer than the sheet member 41B.

When the strap 50 is tightened around the leg of the wearer, the cushion pad 44B is moved toward the wearer's leg along with the sheet member 41B. The function of the cushion pad 44B is to provide additional comfort and support to the wearer's leg. The cushion pad 44B may have any suitable shape and size which can fit ergonomically the wearer's leg.

Alternatively, the elastic sheet member 41B may be formed into a thick, resilient and soft pad which is directly attached to the inner surface of the rear shell portion 30. In this case, the thick, resilient and soft pad will perform the functions of both the sheet member 41B and the cushion pad 44B.

Figure 9:
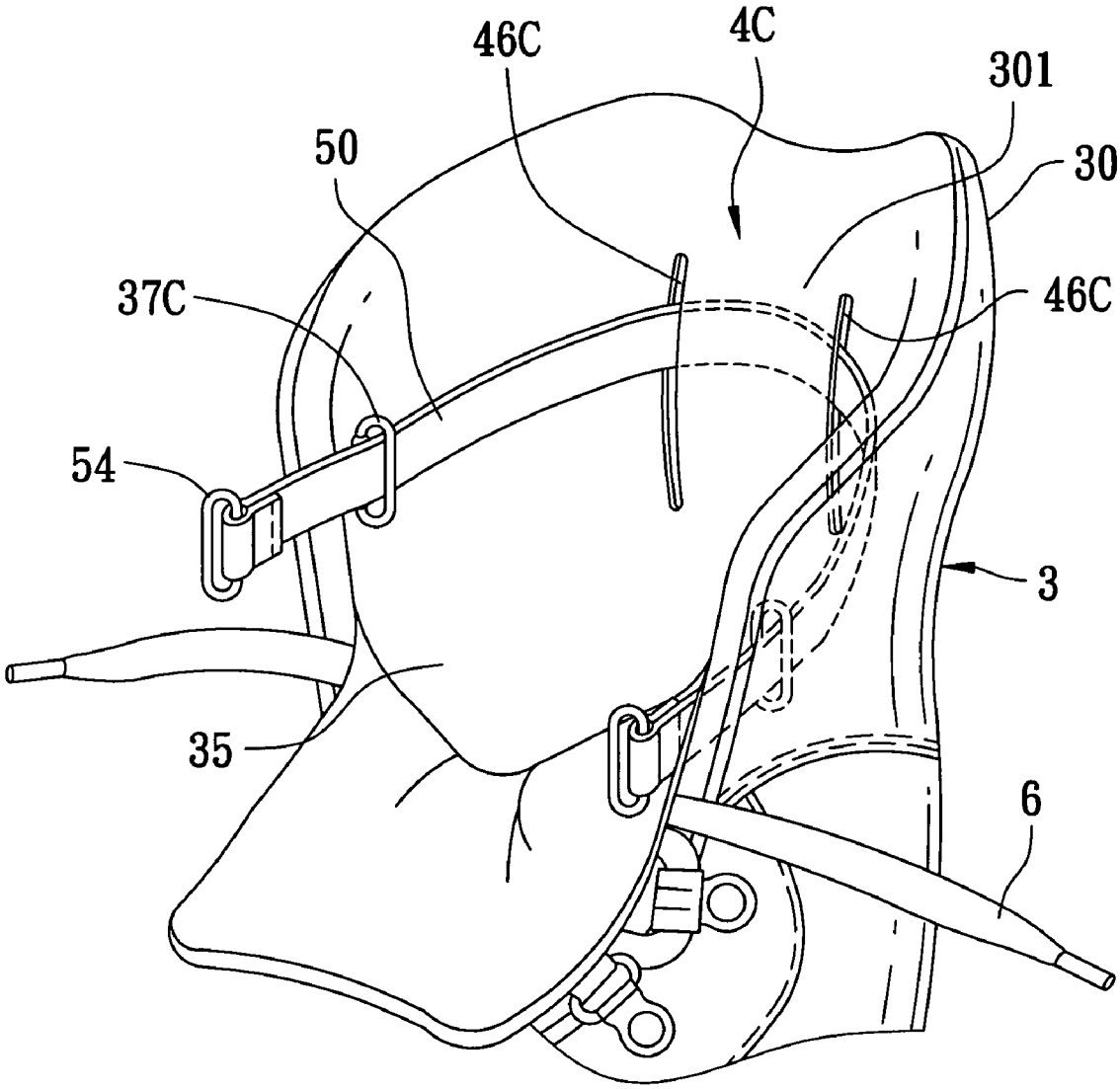
FIG. 9 is a fragmentary perspective view of the sixth preferred embodiment of the present invention.
Figure 10:
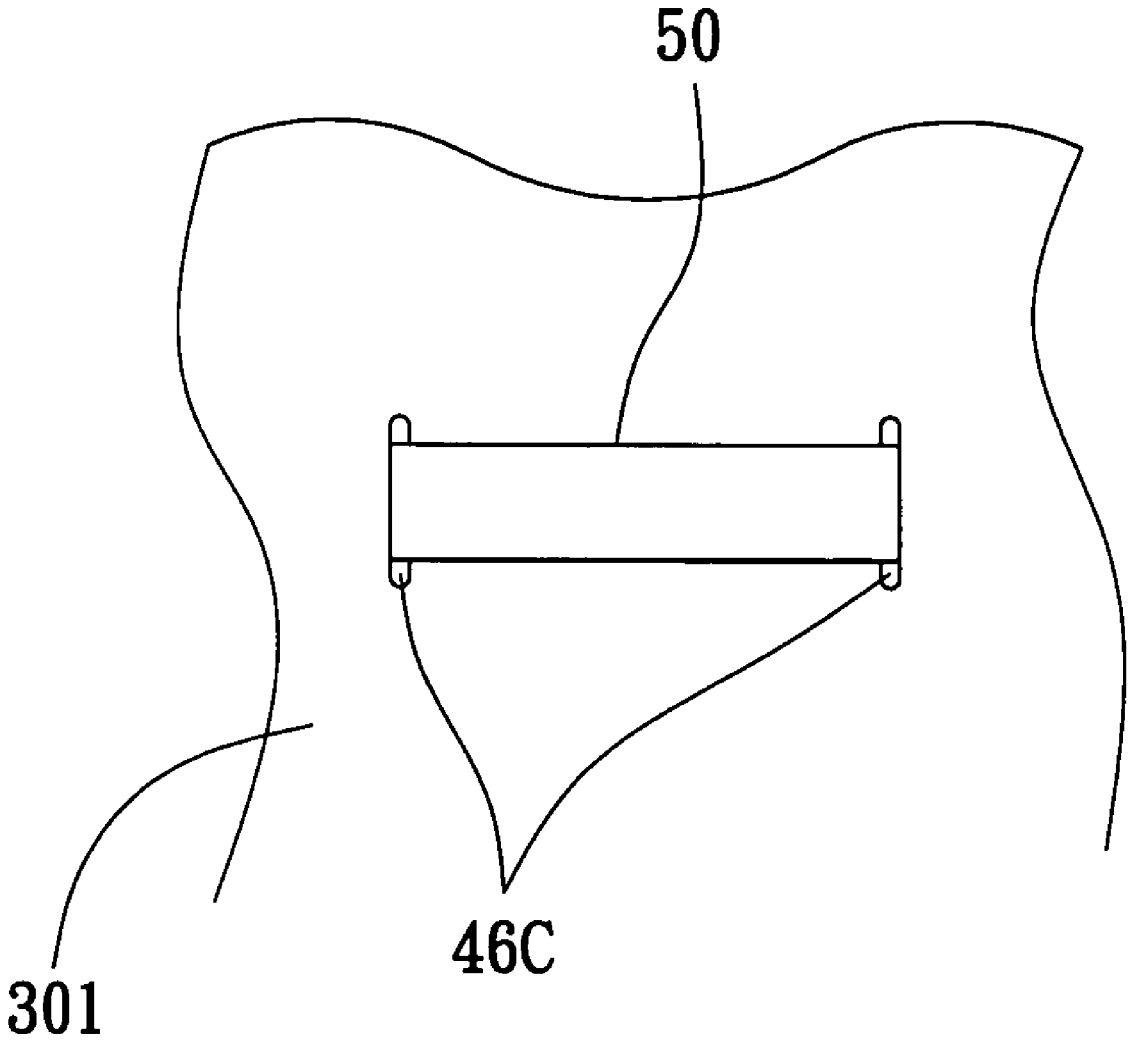
FIG. 10 is a fragmentary view showing a rear side of the rear shell portion of the upper in the sixth embodiment.

Referring to FIGS. 9 and 10, a sixth preferred embodiment of the shoe according to the present invention is substantially similar to the first preferred embodiment. However, in this embodiment, an attachment unit 4C is used in place of the attachment unit 4 of the first embodiment. Besides, ring members 37C are used instead of the slots 37 used in the first embodiment. The attachment unit 4C includes a pair of spaced apart openings 46C formed in the rear wall part 301 of the rear shell portion 30. The strap passes through one of the openings 46C to extend outwardly of the rear shell portion 30 and returning into the rear shell portion 30 by passing through the other one of the openings 46C. When the strap 50 is tightened, the rear wall part 301 is pulled toward the wearer's leg.

As the strap 50 extends outward through the openings 46C, a part of the strap 50 is exposed at the outer side of the rear shell portion 301. The exposed part of the strap 50 may be covered by a protection layer (not shown) to improve the appearance of the shoe.

The ring members 37C are provided adjacent to the tongue opening 35. The two end portions of the strap 50 pass respectively through the ring members 37C before they extend out of the rear shell portion 30 through the tongue opening 35.

Figure 11:
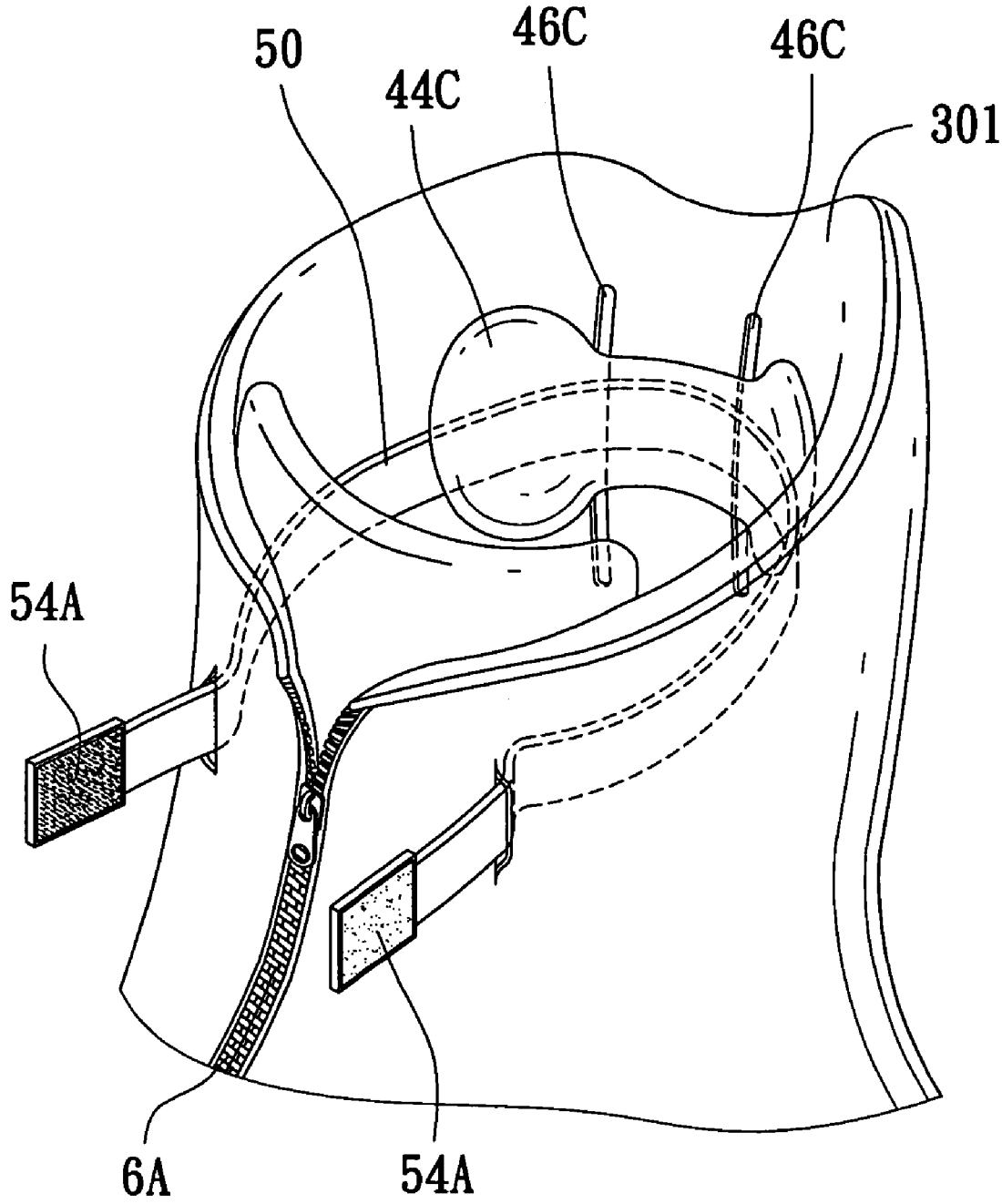
FIG. 11 is a fragmentary perspective view of the seventh preferred embodiment of the present invention.

Referring to FIG. 11, a seventh preferred embodiment of the shoe according to the present invention is substantially similar to the sixth preferred embodiment. However, this embodiment additionally includes a cushion pad 44C which is disposed over the inner surface of the rear wall part 301 and extends across the two openings 46C so that the presence of the openings 46C will not cause discomfort to the wearer. The cushion pad 44C may be attached to the inner surface of the rear wall part 301 through any connection means such as sewing stitches, Velcro fasteners, snap fasteners, or the like.

The function of the cushion pad 44C is similar to that of the cushion pad 44B of the fifth preferred embodiment. In addition, a zipper 6A is provided in place of the shoelace 6, and the fastening members 54A are used instead of the fastening members 54.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A shoe comprising:

an upper including a rear shell portion, and a front shell portion extending forwardly from said rear shell portion, said rear shell portion including a rear wall part, a front wall part, and left and right wall parts extending between said rear and front wall parts, said rear, front, left and right wall parts confining a receiving space which opens upward;

a leg support member disposed within said rear shell portion, said leg support member including a strap that extends from said rear wall part to said left and right wall parts and that has two end portions, at least one of said end portions extending forwardly and outwardly from said receiving space and being manipulatable to tighten said strap around the leg of a wearer, which is inserted into said receiving space; and an attachment unit connected to an inner surface at said rear shell portion at said rear wall part, said strap being attached to said attachment unit, said strap being exposed from said inner surface and extending into said receiving space, wherein, when said strap is tightened, said strap can contact against the leg directly.

2. The shoe as claimed in claim 1, wherein said leg support member further includes a fastening unit attached to said at least one of said end portions of said leg support member.

3. The shoe as claimed in claim 2, wherein said strap has both of said end portions extending outwardly from said rear shell portion, said fastening unit having two fastening members attached respectively to said end portions of said strap.

4. The shoe as claimed in claim 3, further comprising a shoelace attached to said upper, said fastening members being connected to said shoelace.

5. The shoe as claimed in claim 2, further comprising a zipper attached to said front wall part, both of said end portions of said leg support member extending outwardly from said front wall part on two sides of said zipper, said fastening unit having two fastening members attached respectively to said end portions.

6. The shoe as claimed in claim 2, wherein the other one of said end portions of said leg support member is secured to an inner side of one of said left and right wall parts, said fastening unit having two fastening members, one of said fastening members being connected to said one of said end portions of said leg support member, the other one of said fastening member being attached to an outer side of said rear shell portion.

7. The shoe as claimed in claim 2, wherein said fastening unit includes fastening rings attached to said at least one of said end portions of said leg support member.

8. The shoe as claimed in claim 2, wherein said fastening unit includes hook-and-loop fasteners attached to said at least one of said end portions of said leg support member.

9. The shoe as claimed in claim 1, wherein said attachment unit includes a passage connected to said rear wall part, said strap passing through said passage.

10. The shoe as claimed in claim 9, wherein said attachment unit includes an elastic sheet member which has two opposite ends secured to said rear wall part, said passage being defined between said rear wall part and said sheet member and between said opposite ends of said sheet member.

11. The shoe as claimed in claim 1, wherein said attachment unit has at least two spaced apart openings formed in said rear wall part, said strap passing through one of said openings to extend outwardly of said rear shell portion and returning into said receiving space of said rear shell portion by passing through the other one of said openings.

12. The shoe as claimed in claim 1, further comprising an attachment unit connected to said rear shell portion, said leg support member being immovably fixed to said attachment unit.

13. The shoe as claimed in claim 1, further comprising a cushion pad attached to said inner surface of said rear shell portion and associated with said attachment unit.

14. The shoe as claimed in claim 13, wherein said attachment unit includes an elastic sheet member which has two opposite ends secured to said inner surface of said rear shell portion and which defines a passage between said sheet member and said inner surface, said cushion pad being attached to said elastic sheet member.

15. The shoe as claimed in claim 10, wherein said elastic sheet member is a thick, resilient and soft sheet member.

16. The shoe as claimed in claim 11, further comprising a cushion pad which is disposed over an inner surface of said rear wall part and across said openings.

* * * * *